US007258163B2

(12) United States Patent
Kravits et al.

(10) Patent No.: US 7,258,163 B2
(45) Date of Patent: Aug. 21, 2007

(54) METHOD AND SYSTEM FOR PRODUCTION OF GAS AND WATER FROM A COAL SEAM USING WELL BORES WITH MULTIPLE BRANCHES DURING DRILLING AND AFTER DRILLING COMPLETION

(75) Inventors: Stephen J. Kravits, Pleasant Hills, PA (US); Bruce D. Rusby, Jefferson Hills, PA (US); John K. Wood, Harrison City, PA (US)

(73) Assignee: Target Drilling, Inc., Jefferson Hills, PA (US)

( * ) Notice: Subject to any disclaimer, the term of this patent is extended or adjusted under 35 U.S.C. 154(b) by 0 days.

(21) Appl. No.: 11/223,655

(22) Filed: Sep. 9, 2005

(65) Prior Publication Data

US 2006/0005972 A1 Jan. 12, 2006

Related U.S. Application Data

(63) Continuation of application No. 10/406,622, filed on Apr. 3, 2003, now Pat. No. 6,968,893.

(60) Provisional application No. 60/369,683, filed on Apr. 3, 2002.

(51) Int. Cl.
*E21B 7/04* (2006.01)

(52) U.S. Cl. ..... 166/50; 166/313; 175/62

(58) Field of Classification Search ..... 166/80, 166/313; 175/61, 62, 69, 70
See application file for complete search history.

(56) References Cited

U.S. PATENT DOCUMENTS 6,280,000 B1 8/2001 Zupanick
6,357,523 B1 3/2002 Zupanick
6,412,556 B1 7/2002 Zupanick
6,425,448 B1 7/2002 Zupanick et al.
6,439,320 B2 8/2002 Zupanick
6,454,000 B1 9/2002 Zupanick (Continued)

OTHER PUBLICATIONS

R.J. "Bob" Stayton, "Horizontal Wells Boost CBM Recovery", Special Report: Horizontal & Directional Drilling, Aug. 2002, (pp. 71, 73-75).

David C. Oyler, et al., "Directional Drilling for Coalbed Degasification, Program Goals and Progress in 1978", RI 8380 Bureau of Mines Report of Investigations/1979, United States Department of the Interior; "Directionally Controlled Drilling to Horizontally Intercept Selected Strata, Upper Freeport Coalbed, Green County, Pa.", RI 8231 Bureau of Mines Report of Investigations/1977, United States Department of the Interior, (11 pgs).

*Primary Examiner*—William Neuder
(74) *Attorney, Agent, or Firm*—The Webb Law Firm

(57) ABSTRACT

A system for producing gas and water from a gas bearing strata during and after drilling completion. The system includes a directional drilling system, a main bore and pump. The directional drilling system includes a drill and a drill string. The main bore intersects the gas bearing strata and has an upper vertical portion, a lower horizontal portion and a curve portion connecting the vertical portion and the horizontal portion. Waste material collects temporarily until pumped to the surface by the pump installed in the bore.

14 Claims, 4 Drawing Sheets

U.S. PATENT DOCUMENTS 6,478,085 B2 11/2002 Zupanick
6,497,556 B2 12/2002 Zupanick et al.
6,598,686 B1 * 7/2003 Zupanick ..... 175/62
6,968,893 B2 * 11/2005 Rusby et al. ..... 166/50
2001/0010432 A1 8/2001 Zupanick
2001/0015574 A1 8/2001 Zupanick
2002/0096336 A1 7/2002 Zupanick et al.
2002/0100616 A1 8/2002 Zupanick et al.
2002/0108746 A1 8/2002 Zupanick et al.
2002/0117297 A1 8/2002 Zupanick et al.
2002/0134546 A1 9/2002 Zupanick
2002/0148613 A1 10/2002 Zupanick
2002/0148647 A1 10/2002 Zupanick
2002/0155003 A1 10/2002 Zupanick et al.
2003/0221836 A1 * 12/2003 Gardes ..... 166/369

* cited by examiner

METHOD AND SYSTEM FOR PRODUCTION OF GAS AND WATER FROM A COAL SEAM USING WELL BORES WITH MULTIPLE BRANCHES DURING DRILLING AND AFTER DRILLING COMPLETION

CROSS REFERENCE TO RELATED APPLICATION

This application is a continuation of U.S. patent application Ser. No. 10/406,622, filed Apr. 3, 2003, now U.S. Pat. No. 6,968,893, entitled Method and System for Production of Gas and Water from a Gas Bearing Strata During Drilling and After Drilling Completion which claims the benefit of U.S. Provisional Patent Application No. 60/369,683, filed Apr. 3, 2002, which is hereby incorporated by reference.

BACKGROUND OF THE INVENTION

1. Field of the Invention

The present invention relates generally to systems and methods for the recovery of subterranean deposits, and, more particularly, relates to systems and methods for the removal of inseam water, drilling effluent and the production of gas, typically methane, from a gas bearing strata.

2. Background of the Invention

Coal is a large energy source. It has been mined from the earth for many years. Deposits of coal beneath the ground surface are positioned in generally horizontal coal seams and include substantial quantities of methane gas entrained in the coal deposits. In underground coal mining, methane gas poses a significant safety risk to the miners. In the past, the methane gas entrained in the coal deposits was simply liberated from the coal, mixed with air in the mine which diluted it to a safe concentration, and the mixture was ventilated to the outside environment. The methane was simply dissipated into the environment and provided no meaningful resource. However, in recent years, this entrained methane gas has been an efficient energy source and is sold commercially. Typically the methane gas is used as a driving source for energy-producing equipment, such as generators or the like, or can be added to natural gas pipelines.

Utilizing the gas as an energy source requires that the gas be extracted in a concentrated state and captured. Extracting methane from the coal seams in a concentrated state has been achieved by drilling boreholes generally horizontally into the coal seam that can extend several thousands of feet.

During and after the methane drilling process, dewatering must occur. Since coal seams may have a significant amount of subterranean water associated with them, water must be drained from the coal seam in order to produce the methane. Further, during the drilling process, water may be used at the drilling tip, creating a slurry of drill cuttings, which also must be removed from the borehole. Water and drill cuttings can block the migration of gas through the coal seam to the borehole and therefore must be removed to permit degasification. Additionally, some of the water used in the drilling process can be forced under pressure into the coal seam, further saturating the gas reservoir, which impedes the migration of gas to the borehole. Therefore, dewatering must occur both during the drilling process and after drilling has been completed.

Long, generally horizontal boreholes that remain in the coal seam are the most effective manner to extract and capture the gas entrained in the coal seam providing the suitable reservoir and material strength characteristics exist in the coal seam. Horizontal and generally horizontal boreholes can be effective in a suitable coal seam because they remain in contact with the gas reservoir (the coal bed) for long distances. Typical generally horizontal directional boreholes are drilled from inside the coalmine, which are relatively easy to dewater. This is due to the ability of the gas to purge water from the borehole because the boreholes are generally level with the end of the borehole, therefore, the gas does not have to overcome substantial hydraulic head to purge the water from the borehole. However, the horizontal directional boreholes drilled from inside the coal mine create several safety concerns, require the use of specialized equipment, and usually have limited borehole productive life. Transportation of gas in a pipeline, inside an underground coalmine, requires considerable maintenance and safety inspections due to the explosive nature of gas. Although directionally drilled inseam boreholes can reach several thousand feet, the boreholes do not always provide complete degasification before the coal seam is mined. Oftentimes the coal mining operator must mine the coal in an area before maximum degasification has been achieved. Therefore, a method to maximize coal bed gas recovery while reducing the safety risks to the coal operators is desirable. Furthermore, in areas not associated with current or future coal mining, the dewatering methods described herein, both during and after drilling will maximize coal seam methane recovery.

It is an object of the present invention to overcome the deficiencies inherent in the prior art. It is another object of the present invention to provide a method for producing gas from a coal seam yielding increased operator safety. It is another object of the present invention to provide a method for producing gas from a coal seam while simultaneously producing in-situ water, water induced in the coal seam, and drill cuttings while drilling by the drill mechanism during the directional drilling operation. It is yet another object of the present invention to provide a method of simultaneously producing gas and water from a coal seam after drilling is complete to allow for increased gas exploitation of a coalfield.

SUMMARY OF THE INVENTION

Accordingly, the present invention is directed to a system for producing gas, water and drilling effluent from a gas bearing strata during and after drilling completion. The system includes a directional drilling system, a main bore and a pump. The directional drilling system includes a drill for drilling or cutting an object area of the gas bearing strata and a drill string connected to the drill and configured to power and control the drill. The main bore includes an upper substantially vertical portion, a lower substantially horizontal portion or portions and a curve portion connecting the vertical portion and horizontal portion. The main bore also intersects the gas bearing strata. Additionally, the system may include branched bores that extend from the horizontal portion of the main bore. After drilling is completed, the pump pumps material including drill effluent to the surface by the pump installed in the main bore.

The system may further include a directional drainage sumphole bore that exits the horizontal portion of the main bore and extends in a direction that may be at least partially inclined downwardly with respect to the horizontal portion of the main bore. The directional drainage bore may be configured to allow or facilitate the installation of a dewatering device or pump where waste material collects temporarily after drilling completion until pumped to the surface by the pump installed in the sumphole. The directional drainage sumphole may also exit the curve portion of the main bore.

During drilling operations, the system may use either two concentric casings or one casing and a compressed gas tubing, to transport compressed air to the curve portion of the bore. A system using two concentric casings includes an outer casing and an inner casing. The outer casing and the inner casing may be located on the vertical portion of the main bore and may extend into the curve portion of the main bore. The drill string is located within the inner casing. Compressed gas may be pumped through an annular space between the outer casing and the inner casing thereby allowing a mixture of the compressed gas and waste material to be removed through an annular space between the inner casing and the drill string.

During drilling, the system using one casing and a compressed gas tubing may fixedly locate the compressed gas tubing in the vertical portion of the main bore. Compressed gas may be pumped through the tubing thereby allowing a mixture of the compressed gas and waste material to be removed through an annular space between the casing and the drill string located within the casing.

The present invention is also directed to a method for producing gas, water, and drilling effluent from a gas bearing strata both during and after drilling completion. The first step includes drilling a main bore, having an upper vertical portion, a lower horizontal portion, and a curve portion connecting the vertical portion and the horizontal portion, to intersect the strata. A first conduit may be fixed to a top of the vertical portion of the main bore and may extend through the curve portion and to the horizontal portion of the main bore. Removal of residual water and drill effluent from the main bore during drilling operations occurs. A recovery gas produced from the strata through the main bore is passed through the first conduit. Recovery gas produced from the strata through the main bore and branch bores is collected.

The method further includes an internal conduit and an external conduit. The diameter of the internal conduit may be less than the diameter of the external conduit and the area between the external conduit and the internal conduit may be capped so that recovery gas passes through the internal conduit. The method may also further include the step of installing a pump at a distal end of the curve portion of the main bore to remove water and drill effluent. Also included may be the step of drilling a drainage sumphole bore that exits the horizontal portion of the main bore and extends in a direction at least partially inclined downwardly with respect to the horizontal portion of the main bore after drilling completion of the horizontal potion of the main bore. A pump may be installed in the drainage sumphole bore where water temporarily collects until pumped to the surface by the pump.

The method may also include the step of drilling an in-mine horizontal borehole at a horizontal incline intersecting the horizontal portion of the main bore, whereby water and drill effluent removal occurs within the in-mine horizontal borehole and gas produced from the horizontal portion may be collected through the vertical portion of the main bore. The collection of recovery gas may occur through a plurality of boreholes. The step of fixing the conduit includes an inner conduit and an outer conduit. A drill string may be located within the conduit. Water and drill effluent may be removed by pumping compressed gas through an annular space between the outer conduit and the inner conduit and removing a mixture of the compressed gas and waste material through an annular space between the inner casing an the drill string during drilling. After drilling completion, compressed gas may be passed through the conduit, forcing a mixture of compressed gas and waste material up through the tubing located adjacent the conduit. The method may also include a tubing with an internal diameter less than the external tubing diameter of the conduit and the area between the conduit and tubing capped to allow recovery gas pass through the tubing to the surface. Additionally, the method may include a tubing with an internal diameter of the tubing less than the external diameter of the conduit. The tubing is positioned in the bore adjacent to and external of the conduit. The conduit is capped so that recovery gas passes through the tubing up to the surface.

The present invention, both as to its construction and its method of operation, together with additional objects and advantages thereof, will best be understood from the following description of specific embodiments when read in connection with the accompanying drawings.

DESCRIPTION OF THE PREFERRED EMBODIMENTS

Figure 1:
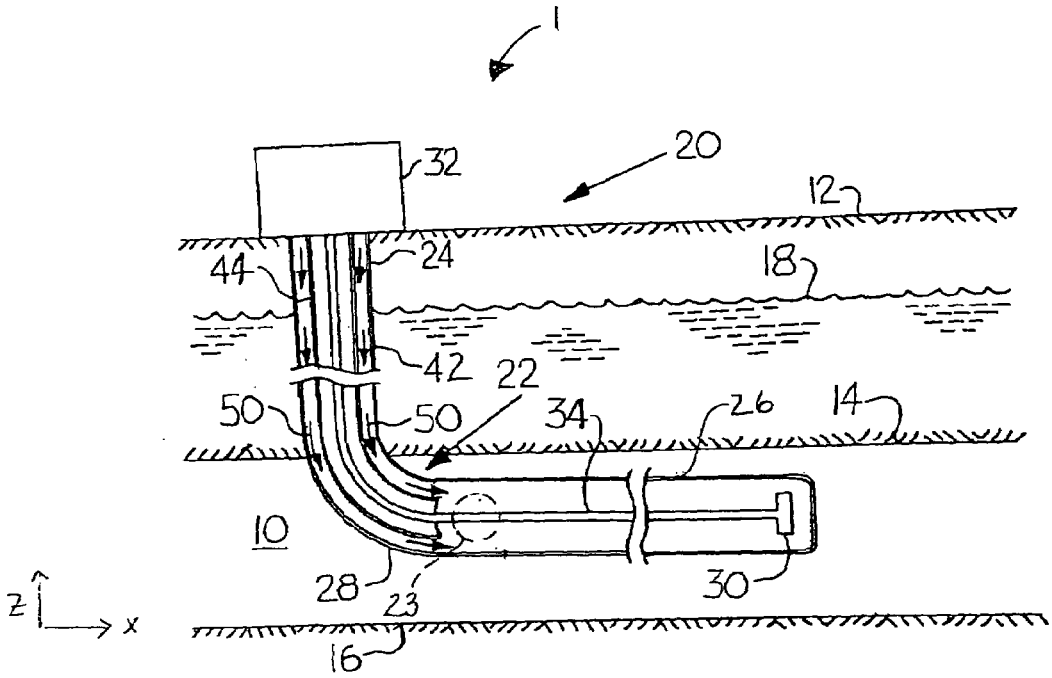
FIG. 1 is a side schematic view of a system for producing gas and water from a coal seam during directional drilling according to the present invention.

A complete understanding of the invention will be obtained from the following description when taken in connection with the accompanying drawing figures, wherein like reference characters identify like parts throughout.

For purposes of the description hereinafter, the terms "upper", "lower", "right", "left", "vertical", "horizontal", "top", "bottom", and derivatives thereof shall relate to the invention as it is oriented in the drawing Figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

Hence, specific dimensions and other physical characteristics related to the embodiments disclosed herein are not to be considered as limiting.

As shown in FIG. 1, the present invention is a system 1 for drilling and producing gas, typically methane, water and drilling effluent from a gas bearing strata. The system may be utilized both during directional drilling and after drilling is complete. The gas bearing strata may be any geologic medium, preferably a coal seam, 10. Coal seam 10 is located below the earth's surface 12 and extends substantially horizontally and parallel with the surface 12. For example, coal seam 10 may lie up to 1,000 to 2,000 feet below the surface 12 and generally have a thickness of a few feet to about 50 feet. The thickness of the coal seam 10 is defined by the strata or roof above 14 and the strata or floor below 16. Also, there is typically a ground water layer 18 or aquifer positioned between the surface 12 and the roof 14. At times, this ground water layer 18 can act as the source of water entrained in the coal seam 10.

In order to extract methane gas from the coal seam 10, the present invention utilizes a directional drilling method. To access an object area of the coal seam 10, from which gas and other products are to be collected, the system 1 includes a directional drilling system 20, a main bore 22 and a pump 23 shown in phantom. The directional drilling system 20 located on the surface 12 includes a directional drilling and surveying mechanism or drill 30 for cutting an object area of the coal seam 10. The directional drilling system 20 also includes a drill string 34 connected to the directional drilling and surveying system and configured to power the drill mechanism 30 and control the vertical and horizontal trajectory of the drill 30 as desired.

The main bore 22 includes an upper substantially vertical portion 24, a lower substantially horizontal portion 26 and a curve portion 28 connecting the vertical portion 24 and the horizontal portion 26. The vertical portion 24 of the main bore 22 begins at the surface 12 and extends to a point approximately 150 to 1,000 feet above the coal seam 10. The curve portion 28 of the main bore 22 begins approximately 150 to 1,000 feet intercepting the coal seam 10 and extends through the coal seam roof 14 and into the coal seam 10. Finally, the horizontal portion 26 of the main bore 22 extends in or adjacent to the coal seam 10 for a horizontal length of about 1,000 to greater than 5,000 feet.

Figure 2:
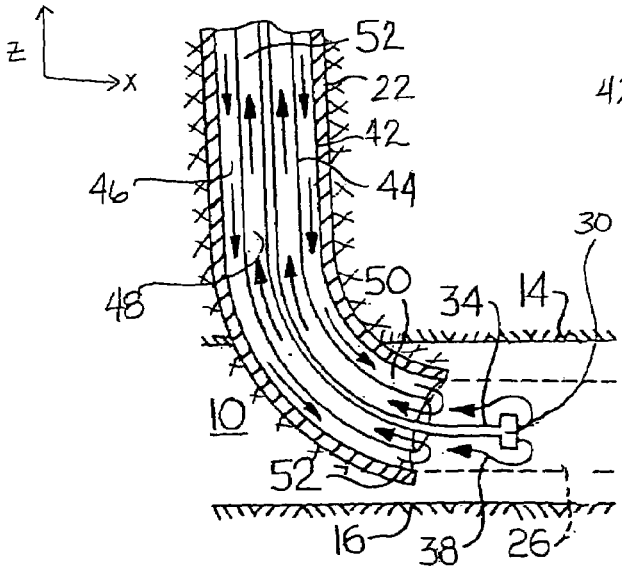
FIG. 2 is a cross-sectional side schematic view of a second embodiment of a system for producing gas and water from a coal seam during directional drilling according to the present invention.

As shown in FIG. 2, the main bore 22 is typically an annular conduit created by directional drilling, which is large enough to allow passage of the drill mechanism 30 and drill effluent or waste material 38 therethrough after installing designated casings or casing and tubing in the vertical portion 24 and curve portion 28 of the main bore 22. Referring back to FIG. 1, the directional drilling system 20 includes a directional drilling station 32 for operating and steering or controlling the direction that the drill mechanism 30 proceeds in. Any directional drilling and surveying system which is known in the art may be used. The directional drilling station 32 is connected to the drill 30 by the drill string 34. Water or a combination of water and air injected through the drill string 34 powers the drill mechanism 30 and provides other operational benefits. For example, injected water assists in cooling the borehole positional surveying tools that are part of the drill string 34 and drill mechanism 30, and also mixes with the drill cuttings to create a slurry that carries the cuttings away from the drill mechanism 30 out of the main bore 22 to the surface 12. These two flows, the entrained ground water combined with the drill water and cuttings become the drilling effluent or waste material 38. The waste material 38 is preferably removed during drilling operations.

The main bore 22 preferably is drilled using a combination of drilling techniques and apparatus that is well known to those skilled in the art. It is also envisioned that a portion of the main bore 22, typically the vertical portion 24 and at least a part of the curve portion 28, uses a casing 42 to protect the main bore 22 from direct water infiltration from the ground water layer 18.

FIG. 2 illustrates dewatering during directional drilling with the use of two casings in one embodiment of the present invention. An outer most casing or first casing or conduit 42 and an inner most casing or second casing or conduit 44 are installed, concentrically or side-by-side, in the vertical portion 24 of the main bore 22. The first casing 42 may be installed and is preferably fixed in position or cemented to the top of the vertical portion 24. The first casing 42 may additionally extend and terminate into the curve portion 28 to just above the coal seam 10, or may further extend and terminate into the coal seam 10. The first casing 42 is of a sufficient diameter, typically about 9-15 inches in diameter, to permit passage of the second casing 44, thereby creating an annular space 46 between the first casing 42 and the second casing 44. The second casing 44 is of a sufficient diameter, typically about 5-8 inches in diameter, to permit passage of the drill string 34 inside the second casing 44. To assist dewatering and drill effluent removal during directional drilling, compressed gas 50, in this case preferably air, is introduced into the annular space 46 between the first casing 42 and the second casing 44 at the surface 12 and exits the annular space 46 at or near the end of the curve portion 28 of the main bore 22. Upon exiting, the compressed gas 50 mixes with the waste material 38 creating a mixture 52, thereby assisting to lift the waste material 38 to the directional drilling system through an annular space 48 formed by the outside of the drill string 34 and the inside of the second casing 44. Alternatively, the pump 23 is provided to pump the mixture 52 to the surface. The waste material 38 includes water, drill cuttings, drill effluent and the like. The addition of compressed gas 50 to the drill effluent 38 changes its specific gravity, creating resulting mixture 52 lighter than drill effluent or waste material 38 alone. This lighter mixture 52 of compressed gas and drill effluent or waste material is forced under pressure up through the annular space 48 between the inside of the second casing 44 and the outside of the drill string 34 and exits at the surface 12. In this manner, waste material 38 is removed from the main bore 22 during drilling operations.

Figure 3:
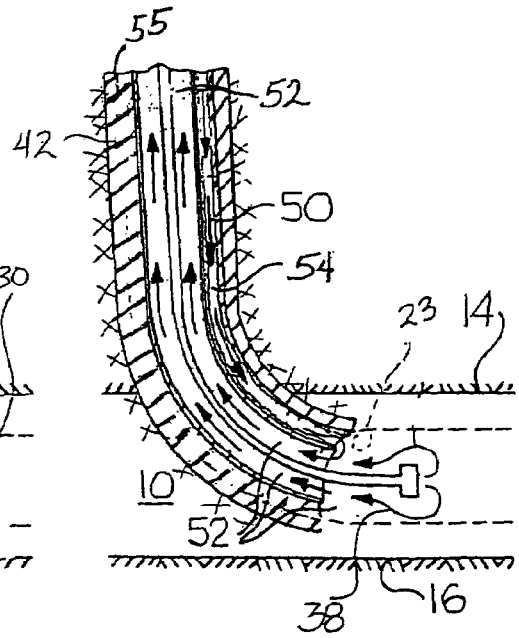
FIG. 3 is a cross-sectional side schematic views of a third embodiment of a system for producing gas and water from a coal seam during directional drilling according to the present invention.
Figure 3A:
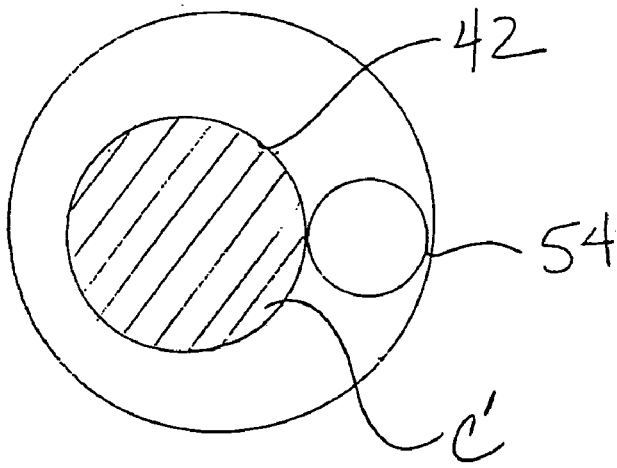
FIG. 3*a* is a top schematic view according to the embodiment shown in FIG. 3.

FIGS. 3 and 3*a* illustrate another embodiment of the present invention, utilizing a casing and a tubing to produce gas and dewater during drilling. This alternative embodiment includes the use of the first casing or conduit 42 with the drill string 34 located within the first casing 42 and a compressed gas tubing or conduit 54. The first casing 42 and tubing 54 may be cemented with grout 55 in the vertical portion 24 as well as the curve portion 28 of the main bore 22. In other words, tubing 54 and the first casing 42 are side-by-side or adjacent to each other and may have their external surfaces fixed to each other in addition to being fixed in the vertical portion 24 or curve portion 28. Preferably, the tubing 54, which is positioned external of the first casing 42, has an internal diameter less than the internal diameter of the first casing 42 used in the embodiment shown by FIG. 2. Compressed gas 50 is forced in through the tubing 54 to lift the drill effluent or waste material 38 to the surface 12 through an internal annular space of the first casing 42 and the outside of the drill string 34. The drill effluent or waste material 38 is removed in a similar manner as discussed hereinabove. In particular, the lighter mixture 52 of compressed gas and drill effluent or waste material is forced under pressure up through the internal annular space of the first casing 42 and the outside of the drill string 34.

Figure 4:
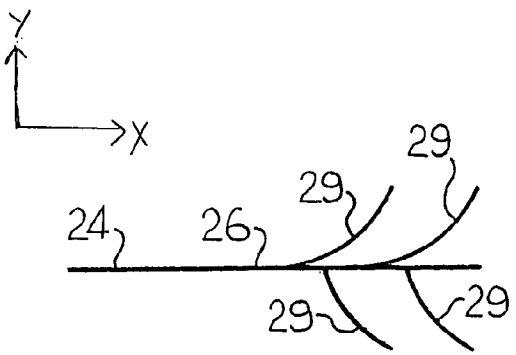
FIGS. 4 and 5 are plan schematic views of further embodiments of the system for producing gas and water from a coal seam according to the present invention.
Figure 5:
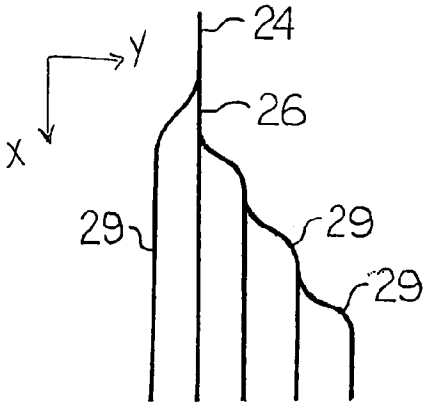

Further embodiments of the present invention are illustrated in FIGS. 4 and 5. The use of the directional drilling system 20 allows much greater gas exploitation and geologic exploration of the coal seam 10. The only limitation to the horizontal length of the horizontal portion 26 of the main bore 22 is the length of the drill string 34 with the drill 30 attached and associated directional drilling capabilities. Preferably, generally horizontal branched bores 29 can be drilled from the main bore 22 that extend obliquely to the axis of the main bore 22, such as the pinnate system. The pinnate system includes horizontal borehole patterns to satisfy a variety of applications, such as gas recovery, oil recovery, and has been known in the art. The horizontal portion 26 of the main bore 22 and the branched bores 29 can be configured in a variety of patterns and directions with multiple branches in any direction or length to maximize gas production. The quantity, orientation and configuration of the branched bores 29 depend on several factors and are very site specific. Preferably, the horizontal portion 26 of the main bore 22, and the branched bores 29 may extend as long as required to allow for maximum gas exploitation of the coal seam 10. Additionally, the horizontal portion 26 and the branched bores 29 can be utilized in other applications, such as degasification, coalbed exploration, verifying location of abandoned mines or abandoned mine verification and dewatering, etc.

Figure 6:
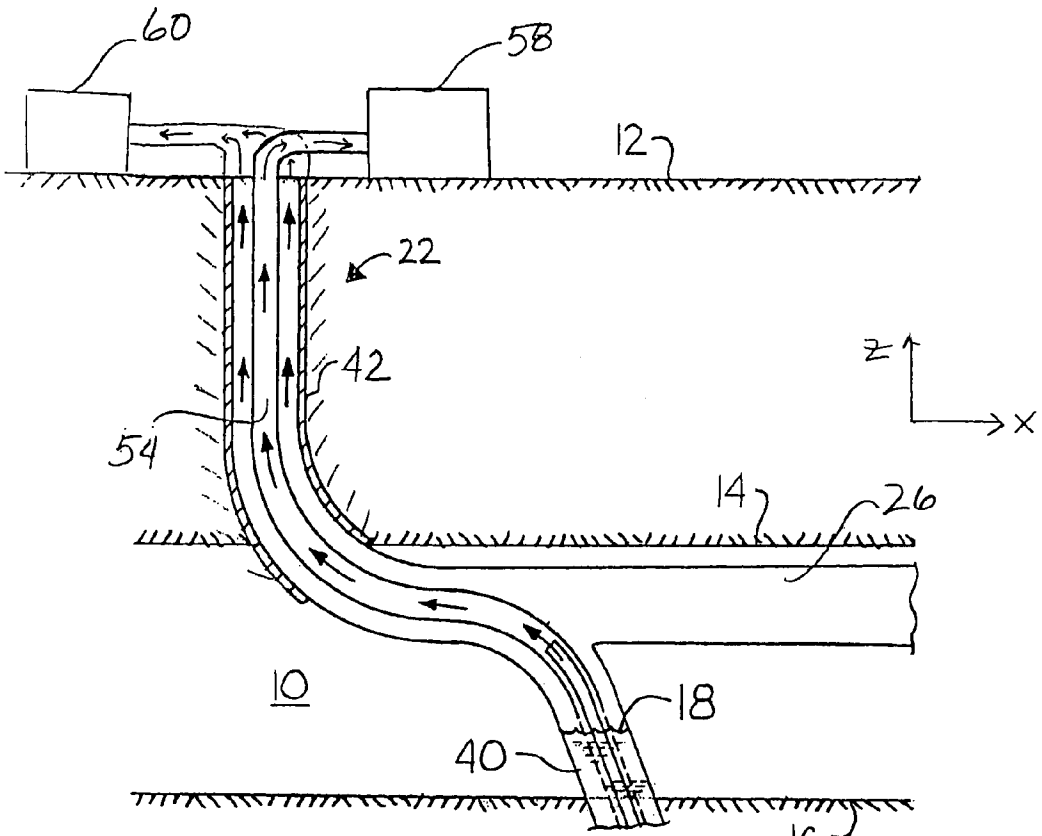
FIG. 6 is a side schematic view of a system for producing gas and water and residual coal cuttings from a coal seam after directional drilling completion according to the present invention.

After directional drilling of the horizontal portion 26 is fully completed, a rathole or drainage sumphole bore 40 may be directionally drilled, as illustrated in FIG. 6. The directional rathole or drainage sumphole bore 40 may be directionally drilled either from the curve portion 28 or from the horizontal portion 26 near the curve portion 28. The directional drainage sumphole bore 40 extends in a direction at least partially inclined vertically and downwardly with for example, a changing inclination or pitch with respect to the horizontal portion 26 and below the horizontal portion 26 to facilitate the installation of a dewatering device where waste material 38 may be temporarily collected until pumped to the surface 12. The partially inclined downward orientation of the directional drainage sumphole bore 40 allows for the installation of the dewatering device or devices where the temporary collection and storage of the drill effluent or waste material 38 occurs. The drill effluent or waste material 38 can be pumped up through the first casing 42, the second casing 44 or the tubing 54, or any other combination thereof of dewatering tubings known in the art. Preferably, as illustrated in FIG. 6, the drill effluent or waste material 38 is pumped up and transported via the tubing 54, having an internal perforated tubing to the end closest the drainage sumphole bore 40, and is collected in a production fluid box 58. Likewise, the recovery gas from the main bore 22 is transported up through the annular spacing between the outside casing 42 and the tubing 54. The recovery gas is collected in a gas collection box 60.

Additionally, after the completion of drilling operations, the drill string 34 is removed and the system 1 can be used for long term dewatering by utilizing some of the recovery gas produced from the coal seam 10. The system 1 may then include several configurations. After the drill string 34 is removed from second casing 44, second casing 44 may be removed and tubing 54 may be inserted into first casing 42. Additionally, first or outer casing 42 may be located adjacent to tubing 54. The first casing 42 is then capped or sealed except for the passage of the tubing 54 therethrough. The recovery gas may or may not be compressed at the surface 12 and pumped down the inside of the first casing 42 to mix with the water and recovery gas produced from the horizontal portion 26 of the main bore 22. In either case, the recovery gas is either produced from the horizontal bore or assisted by additional pressurized recovery gas previously extracted to lift the water out of the curve portion 28 and the vertical portion 24 of the main bore 22 through the tubing 54.

The present invention is also directed to a method for producing gas, typically methane, and removal of drill effluent during drilling and water and residual waste material 38 after drilling is completed, from coal seam 10. The first step includes drilling a main bore 22 intersecting the coal seam 10. The main bore 22 has an upper substantially vertical portion 24, a lower substantially horizontal portion or portions 26 and a curve portion 28 connecting the vertical portion 24 and the horizontal portion 26. The main bore 22 is directionally drilled to intersect the coal seam 10, a gas bearing strata or other target geology or geologic medium depending on the application. The diameter of the main bore 22 intersecting the coal or targeted horizon may be adjusted accordingly to specific geologic and reservoir characteristics. The second step includes installing and fixing a first casing or conduit 42 in position to the top of the vertical portion 24. The casing 42 is preferably cemented to the top of vertical portion 24. Optionally, the casing 42 may be installed to extend into the curve portion 28 and to just above the coal seam 10, or into the coal or gas bearing strata, or targeted zone, as illustrated in FIG. 1.

During directional drilling the substantially horizontal portion 26, dewatering the drill effluent 38 can occur in one of two ways. One method can be to utilize casing 44 of a smaller diameter than the first casing 42 to the top or above the coal or targeted horizon, as illustrated in FIG. 2. Compressed gas 50, preferably air, is supplied into the annular space 46 between the outside of the second casing 44 and the inside wall of the first casing 42. Optionally, a smaller diameter casing 42 shown in FIG. 2 may be installed with the tubing 54 located adjacent to or on the outside of the casing 42 shown in FIGS. 3 and 3*a*. The casing 42, and the tubing 54, may be cemented to the top of or above the coal or targeted horizon, as illustrated in FIG. 3. Compressed gas 50 is then forced into the tubing 54 to assist dewatering and removal of drill effluent 38 during drilling. The compressed gas 50 mixes with the drill effluent 38 and allows return to the directional drilling station 32 through the internal annular space of the casing 42 and the outside wall of the direction drill string 34. Preferably, additional branched bores 29, as illustrated in FIGS. 4 and 5 may be directionally drilled in the coal seam 10, other gas bearing strata, or other targeted horizon depending on the application. As discussed above, the branched bores 29 can be directionally drilled in any pattern or direction with multiple branches in any direction or length.

In operation, many of these branched bores 29 or boreholes are drilled in the coal seam 10 to vent the methane gas to the atmosphere prior to removal by such techniques as longwall mining for example. The prior art method of horizontally drilled holes resulted in the methane flowing into the mine shaft and having to be vented to the atmosphere via well known prior art techniques.

Generally speaking, the vented methane was dispersed into the atmosphere and not recovered. The present invention recognizes that the possibility exists for capturing this methane gas for use. Therefore, after drilling completion of the main bore 22, the drill string 34 is removed. Now with the first or outer casing 42 fixed to at least a top of the vertical portion 24 of the main bore 22, either a tubing 54 is passed through or positioned external to and adjacent to the first casing 42. The inner tubing 54 has an inner diameter less than the inner diameter of the first casing 42.

Figure 3B:
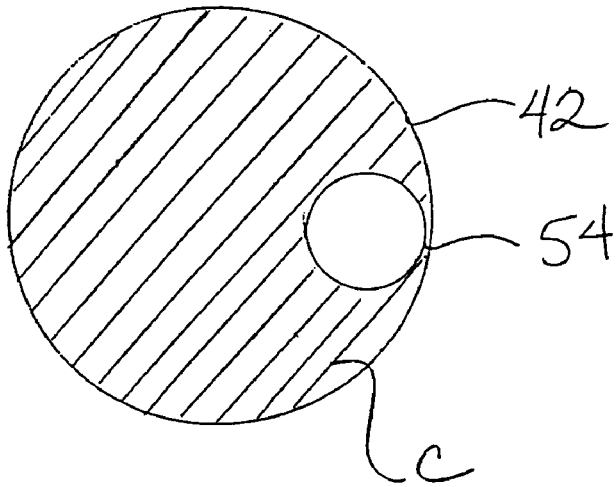
FIG. 3*b* is a top schematic view of the embodiment in FIG. 2 when an inner casing is removed and replaced by the tubing.

In a first embodiment of the removal system, a cap, C, as shown in FIG. 3B, or the like is placed in the cross-sectional area at the top of the vertical portion 24 of the main bore 22 capping casing 42 except for where the tubing 54 may pass therethrough. The entrained recovery gas (i.e. methane) travels from the wall of the horizontal portion of the main bore and exits via the tubing 54. Preferably the tubing terminates adjacent to the lower end of the casing 42. Also as water percolates from the borehole wall and accumulates near the entrance of the tubing 54, it is carried upwardly to exit the tube because of the pressure differential between the escaping methane ($P_H$) and the atmospheric pressure ($P_L$) which is lower than the escaping methane pressure. Therefore the mixture of gas and water can be accumulated with the water separated. The gas can then be stored and either sold or used to generate power or heat on site via power generation, for example. The inner diameter of the tubing 54 defines the removal area when the internal area of the casing 42 is capped.

In the embodiment shown in FIG. 3*a*, the casing 42 is capped by cap C' so that recovery gas can flow up tubing 54. Typically, the area between the borehole wall and the tubing 54 and the casing 42 are grouted and thereby sealed. In some instances a venturi tube or pump can be placed at the end of the tubing 54 such as shown in FIG. 3 to assist the combination of pressurized gas, water and recovery gas flow upwardly to exit the bore hole. In other instances, a mechanical type pump may be placed in the borehole at the bottom of the curve portion 28 to assist removal. In that situation, the casing 42 is uncapped for recovery gas to pass therethrough for collection, while the water is pumped upwardly through the tubing 54. A pump can also be used in the embodiment shown in FIG. 2, whereby likewise the cap is removed for gas to pass through casing 42 and the water is pumped through tubing 54.

In some instances, where a substantial amount of water is flowing into the borehole making removal of the recovery gas difficult, a directional rathole or sumphole 40 may then be drilled as for the water flow through a separate tube and pump positioned in the rathole 40 to remove the water therefrom, while methane gas can freely flow through the tubing 54. In that situation casing 42 is capped. Alternatively, if additional pumping is required in the borehole, then a pump 23 is attached to tubing 54, or another tubing string installed inside casing 42 as previously discussed and the casing 42 is uncapped.

In some extreme cases, a horizontally inclined borehole may be drilled from the underground mine intersecting with the horizontal portion of the main bore. This will permit the water to flow into the mine while the methane gas will flow upwardly through the casing 42. Alternatively, if additional water must be removed then casing 42 is uncapped for the gas to flow therethrough and a pump 23 is attached to the tubing 54 or another tubing string installed inside casing 42.

As can be seen, the advantages of the present invention are two-fold. First, degassing coals seams for removal of coal can be more effective if done above ground rather than below ground within a coal mine. Degasification boreholes can be drilled a greater distance in advance of the coal mining by the present invention. This allows the coal seam to be continuously mined by longwall or other mining techniques, for example, and not experiencing methane caused coal production delays.

Further, the present invention permits the capture of methane from the coal for either sale or use, as opposed to releasing the methane into the atmosphere. Therefore, the mine operation can use the methane gas which used to be released, as a profit center.

After completion of directional drilling of the substantially horizontal portion 26 and/or branched bores 29 in the coal seam 10, gas bearing strata or other geologic medium, additional dewatering can be required. To dewater the horizontal portion 26, gas lift devices or suitable mechanical, electrical, or hydraulic or any combination of electrical, mechanical and hydraulic dewatering pumps may be installed in the curved or horizontal portion on concentric tubing strings or other configuration or dewatering systems which are known in the art may be used. An alternative to dewatering the horizontal portion 26, may be to directionally drill a rathole or sumphole from the curve portion 28. Gas lift devices or suitable mechanical, electrical, or hydraulic or any combination of electrical, mechanical, and hydraulic dewatering pumps may be installed in the rathole or sumphole 40 using concentric tubings to dewater and remove residual drilling fines or cuttings, i.e., waste materials, from the horizontal portion 26 collected in the sumphole or rathole 40 to maximize gas production or to produce other fluids depending on the application of the system. Gas produced from the coal seam 10 can then be recovered through the main bore 22 from the horizontal portion 26 and the branched bores 29 by installing a dewatering device or devices in the directional drainage sumphole 40 using concentric tubings to remove residual cuttings and water while gas is recovered in the annular space between the tubing and inside of the first casing 42.

Figure 7:
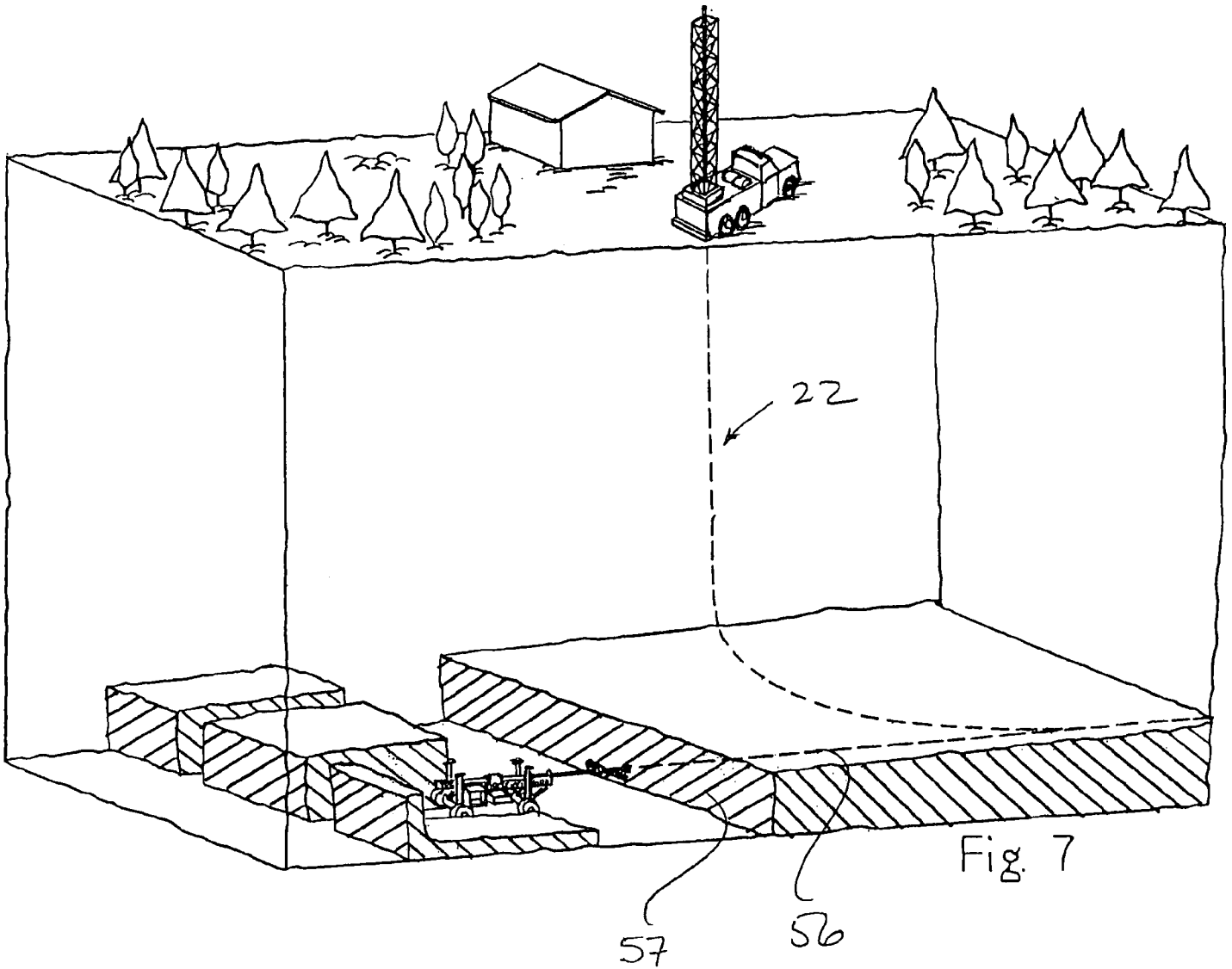
FIG. 7 is a side view of another embodiment according to the present invention.

Additionally, another embodiment of dewatering and producing gas is illustrated in FIG. 7. In this instance, when mine access is available, a horizontal borehole is directionally drilled from within the mine called an in-mine horizontal borehole 56 drilled generally level or up-dip. The in-mine horizontal borehole 56 intersects a coal face 57 and the horizontal portion 26 of the main bore 22 to dewater the system and remove residual fines or cuttings. Dewatering of the vertical portion 24, horizontal portion 26, and curve portion 28 of the system through the in-mine horizontal borehole 56 may be done by gravity without the assistance of electrical, mechanical, or hydraulic means or assisted by electrical, mechanical, or hydraulic devices. Removal of the waste material or drill effluent 38 occurs within the in-mine borehole 52, while recovery gas rises up the main bore 22 and is collected.

Additionally, the present invention need not be limited for used to coal but can also be used in shale oil fields, or the like as discussed below. A plurality of boreholes can also be drilled and connected to one pumping and collection station to limit the cost to secure the methane gas.

Applications of the system or method include substantially vertical portion 24, curve portion 28, and horizontal portion 26 with possible multiple branches 29 in a variety of directions and lengths. They may also include a directional rathole or drainage sumphole bore 40. The application of the present invention may include, but are not limited to: degasification, coalbed exploration; verifying the location of the abandoned mine works or establishing a boundary or safe barrier of coal between anticipated abandoned mine works and future or proposed mining; water drainage or dewatering; and production of gas, oil, water, or other fluids or substances from any geologic medium.

The system and method of the present invention provide a directional drilling and dewatering system for producing gas and water during and after drilling completion from any gas bearing strata such as a coal seam and allow for a safer operating environment. The system and method may also eliminate the need for the use of excessive amount of subterranean equipment, such as a downhole pump and sucker rods, but also the elimination of drilling more than one well bore. In addition, the system and method of the present invention allow for an increased efficiency in drilling operations, and provide maximum coal seam exploitation and exploration and the like, depending on its application.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A system for producing gas and water from a gas bearing strata both during drilling and after drilling completion, the system comprising:

(a) a directional drilling system, comprising:

(i) a drill for drilling or cutting an object area of the gas bearing strata and (ii) a drill string connected to the drill and configured to power and control the drill;

(b) a main bore intersecting the gas bearing strata, the main bore including a first, upper vertical portion in fluid communication with a horizontal portion and a second, lower vertical portion in fluid communication with the horizontal portion; and (c) a pump installed in the main bore to pump waste material to the surface, wherein the first, upper vertical portion of the main bore further comprises an outer casing and an inner casing.

2. The system according to claim 1, further including branched bores extending from the horizontal portion of the main bore.

3. The system according to claim 1, wherein the drill string is located within the inner casing.

4. The system according to claim 3, wherein compressed gas is pumped through an annular space between the outer casing and the inner casing and a mixture of the compressed gas and waste material is removed through an annular space between the inner casing and the drill string.

5. A system for producing gas and water from a gas bearing strata both during drilling and after drilling completion, the system comprising:

(a) a directional drilling system, comprising:

(i) a drill for drilling or cutting an object area of the gas bearing strata and (ii) a drill string connected to the drill and configured to power and control the drill;

(b) a main bore intersecting the gas bearing strata, the main bore including a first, upper vertical portion in fluid communication with a horizontal portion and a second, lower vertical portion in fluid communication with the horizontal portion; and (c) a pump installed in the main bore to pump waste material to the surface, wherein the main bore further comprises a casing and a compressed gas tubing fixed in the first, upper vertical portion of the main bore.

6. The system according to claim 5, wherein the casing and the compressed gas tubing are fixed in the first, upper vertical portion of the main bore.

7. The system according to claim 6, wherein compressed gas is pumped through the tubing and a mixture of the compressed gas and waste material is removed through an annular space between the casing and the drill string located within the casing.

8. A method for producing gas and water from a gas bearing strata both during drilling and after drilling completion, comprising the steps of:

(a) drilling a main bore intersecting the strata, the main bore having a first, upper vertical portion in fluid communication with a horizontal portion and a second, lower vertical portion in fluid communication with the horizontal portion;

(b) fixing a conduit to a top of the first, upper vertical portion;

(c) removing water and drilling effluent from the main bore during drilling operations;

(d) passing a recovery gas through the first conduit, wherein the recovery gas is produced from the strata through the main bore; and (e) collecting the recovery gas, further including an internal conduit and an external conduit, wherein the internal conduit diameter is less than the external conduit diameter and the area between the external conduit and the internal conduit is capped so that recovery gas passes through the internal conduit.

9. The method according to claim 8, wherein the step of collecting recovery gas occurs through a plurality of boreholes.

10. A method for producing gas and water from a gas bearing strata both during drilling and after drilling completion, comprising the steps of:

(a) drilling a main bore intersecting the strata, the main bore having a first, upper vertical portion in fluid communication with a horizontal portion and a second, lower vertical portion in fluid communication with the horizontal portion;

(b) fixing a conduit to a top of the first, upper vertical portion;

(c) removing water and drilling effluent from the main bore during drilling operations;

(d) passing a recovery gas through the first conduit, wherein the recovery gas is produced from the strata through the main bore; and (e) collecting the recovery gas, wherein the conduit includes an inner conduit and an outer conduit.

11. The method according to claim 10, wherein the step of removing water and drill effluent is performed by pumping compressed gas through an annular space between the outer conduit and the inner conduit and removing a mixture of the compressed gas and waste material through an annular space between the inner conduit and a drill string during drilling.

12. A method for producing gas and water from a gas bearing strata both during drilling and after drilling completion, comprising the steps of:

(a) drilling a main bore intersecting the strata, the main bore having a first, upper vertical portion in fluid communication with a horizontal portion and a second, lower vertical portion in fluid communication with the horizontal portion;

(b) fixing a conduit to a top of the first, upper vertical portion;

(c) removing water and drilling effluent from the main bore during drilling operations;

(d) passing a recovery gas through the first conduit, wherein the recovery gas is produced from the strata through the main bore; and (e) collecting the recovery gas, wherein passing of a compressed gas after drilling completion is through the conduit and a mixture of compressed gas and waste material is forced up through tubing located adjacent the conduit.

13. A method for producing gas and water from a gas bearing strata both during drilling and after drilling completion, comprising the steps of:

(a) drilling a main bore intersecting the strata, the main bore having a first, upper vertical portion in fluid communication with a horizontal portion and a second, lower vertical portion in fluid communication with the horizontal portion;

(b) fixing a conduit to a top of the first, upper vertical portion;

(c) removing water and drilling effluent from the main bore during drilling operations;

(d) passing a recovery gas through the first conduit, wherein the recovery gas is produced from the strata through the main bore; and (e) collecting the recovery gas, further including a tubing wherein the internal diameter of the tubing is less than the external diameter of the conduit and an area between the conduit and the tubing is capped so that recovery gas passes through the tubing up to a surface.

14. A method for producing gas and water from a gas bearing strata both during drilling and after drilling completion, comprising the steps of:

(a) drilling a main bore intersecting the strata, the main bore having a first, upper vertical portion in fluid communication with a horizontal portion and a second, lower vertical portion in fluid communication with the horizontal portion;

(b) fixing a conduit to a top of the first, upper vertical portion;

(c) removing water and drilling effluent from the main bore during drilling operations;

(d) passing a recovery gas through the first conduit, wherein the recovery gas is produced from the strata through the main bore; and (e) collecting the recovery gas, further including tubing wherein the internal diameter of the tubing is less than the external diameter of the conduit and the tubing is positioned in the main bore adjacent to and external of the conduit, wherein the first conduit is capped so that recovery gas passes through the tubing up to a surface.

* * * * *